United States Patent [19]

Nelson

[11] 4,071,916

[45] Feb. 7, 1978

[54] APPARATUS FOR ROCKING A BED

[76] Inventor: Yvette E. Nelson, Rte. 4, Box 78, Burleson, Tex. 76028

[21] Appl. No.: 778,687

[22] Filed: Mar. 17, 1977

[51] Int. Cl.[2] ..... A61G 7/00; A47D 9/02

[52] U.S. Cl. ..... 5/62; 5/109

[58] Field of Search ..... 5/62, 105, 106, 107, 5/108, 109

[56] References Cited

U.S. PATENT DOCUMENTS

| | | | |
|---|---|---|---|
| 2,311,542 | 2/1943 | Holme | 5/109 |
| 2,845,635 | 8/1958 | Eyer | 5/109 |
| 3,378,859 | 4/1968 | Parker | 5/109 |
| 3,739,406 | 6/1973 | Koetter | 5/62 |
| 3,748,666 | 7/1973 | Seng | 5/109 |
| 3,758,156 | 9/1973 | Zawadzki | 5/109 |

*Primary Examiner*—Peter M. Caun

*Attorney, Agent, or Firm*—Wofford, Felsman, Fails & Zobal

[57] ABSTRACT

The apparatus comprises a base having bed support structure pivotally coupled thereto for rocking motion about an upper axis. The bed support structure includes a first guide fixedly connected thereto for rocking motion with the bed support structure. A second guide is pivotally connected to the base for rocking motion about a lower axis. A drive, crank, and linkage are employed for rocking the second guide. Coupling means couples the two guides together such that the first guide and hence the bed support structure is rocked about its axis as the second guide is rocked about its axis. Adjusting means adjusts the position of the coupling means relative to the two guides to adjust the angle through which the support structure may be rocked.

7 Claims, 7 Drawing Figures

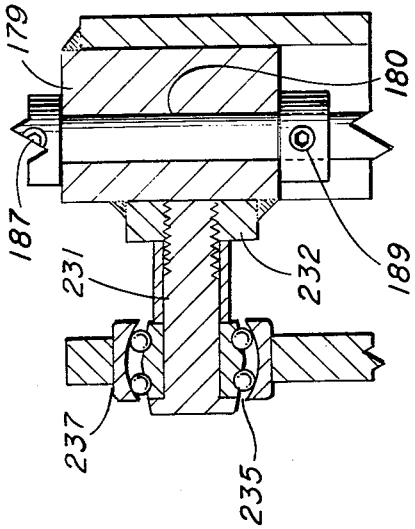
Fig. 6
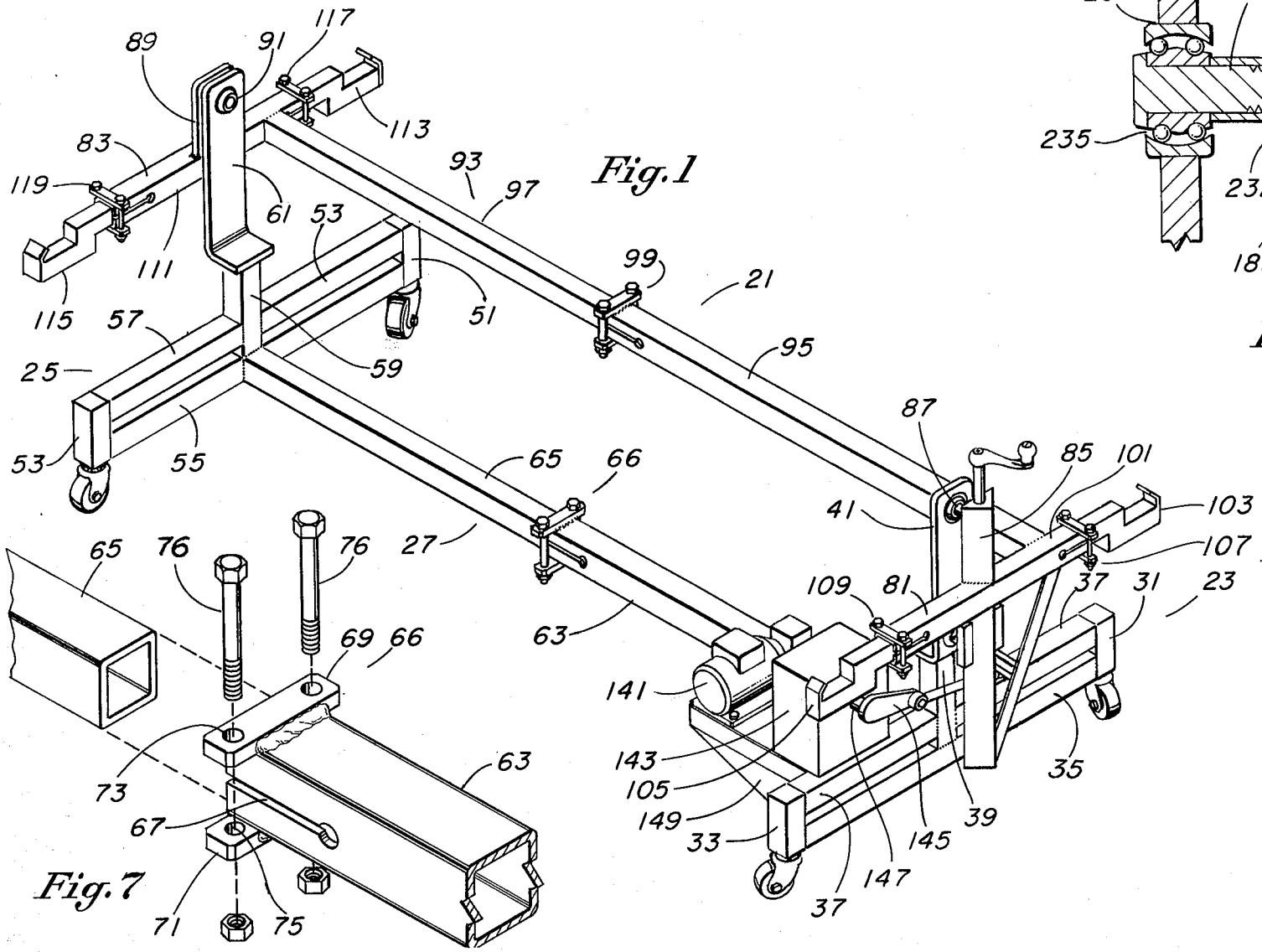
Fig. 1
Fig. 7

183
191

179
233
185
171
95
181
85
81
173
178
175
193
176
85A
5
207
205
203
211
161
201
221
159

221
193
5
177
195

APPARATUS FOR ROCKING A BED

BACKGROUND OF THE INVENTION

As is well known, bed ridden patients must be moved periodically to prevent the development of bed sores. In hospitals and nursing homes, this is done manually by nurses or aides. Systems have been proposed for automatically moving bed ridden patients to prevent bed sores, however, prior to the present invention, I am not aware of any such systems in use.

SUMMARY OF THE INVENTION

It is an object of the present invention to provide an apparatus for supporting a bed and for periodically tilting the bed to shift the weight of a patient. This improves circulation and prevents bed sores. By providing a slow drive to a firm mattress surface only a minimum amount of tilt is required in order to shift the weight to carry out these functions.

It is a further object of the present invention to provide such an apparatus in which the amount of tilt may be readily changed if desired.

In one aspect, the apparatus comprises base means and support means having structure for supporting a bed. The support means is pivotally coupled to the base means for rocking motion about a first axis. Also provided is a crank means and drive means for rotating the crank means. Guide means is privotally coupled to the base means for rocking motion about a second axis spaced from the first axis. An arm has a first end pivotally coupled to the crank means and a second end pivotally coupled to the guide means for rocking the guide means about the second axis as the crank means is rotated by the drive means. Coupling means is provided and which has a first portion coupled to the guide means and a second portion coupled to the support means for rocking the support means about said first axis as the guide means is rocked about said second axis. In addition, adjusting means is provided for adjusting the position of the coupling means relative to the support means and to the guide means to adjust the angle through which the support means may be rocked about said first axis.

BRIEF DESCRIPTION OF THE DRAWINGS

FIG. 1 is a perspective view of the apparatus of the present invention;

FIG. 6 is a partial cross-sectional view of the upper pivot arrangement shown at the right end of the apparatus as seen in FIG. 1; and FIG. 7 illustrates a clamping arrangement for clamping together the tubular members of the apparatus of FIG. 1.

DETAILED DESCRIPTION OF THE INVENTION

Figure 2:
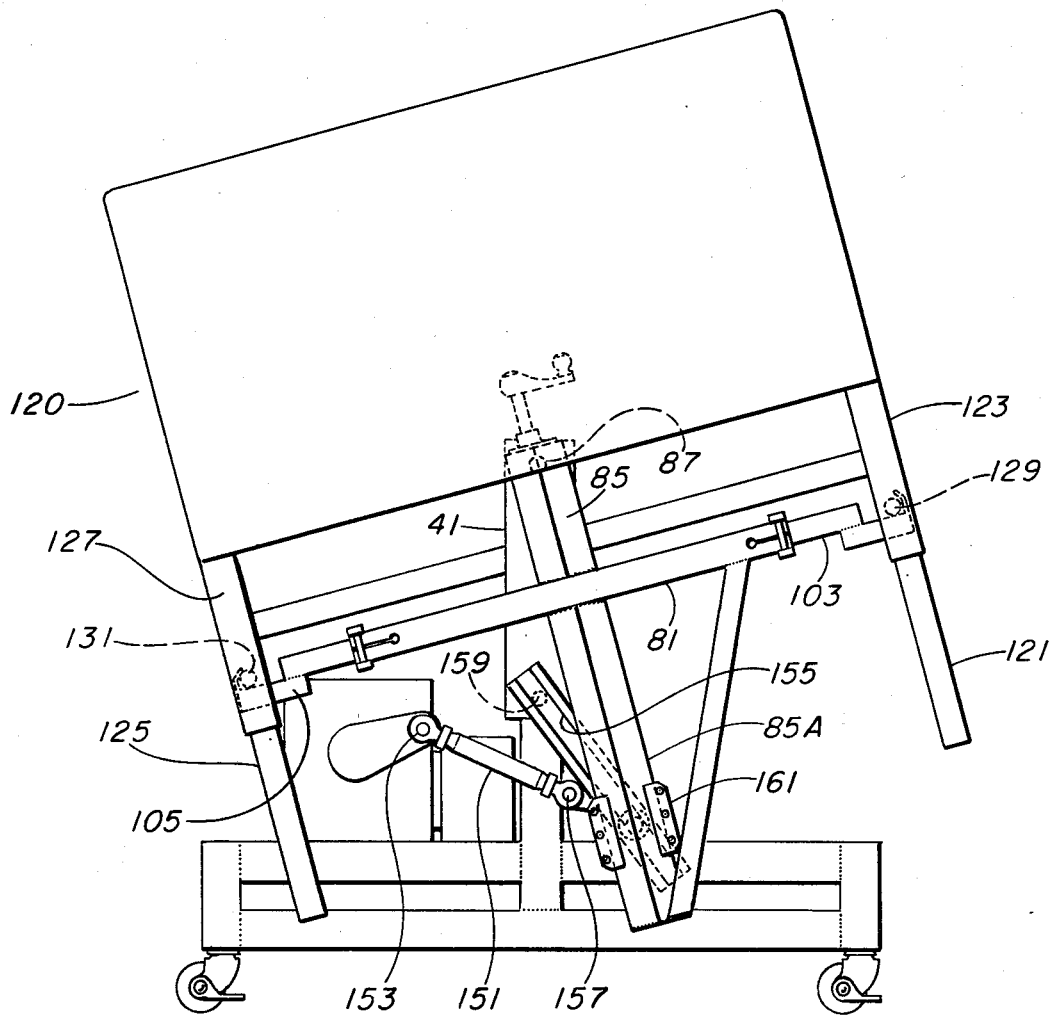
FIG. 2 is an end view of the apparatus of FIG. 1 with a bed supported thereon.

Referring now to FIG. 1, the apparatus of the present invention is identified at 21. It comprises a base having a first end 23 and a second end 25 connected together at spaced apart positions by a longitudinal connecting member 27. End 23 comprises legs 31 and 33 connected together by horizontal frame members 35 and 37. Connected to frame members 35 and 37 is a vertical support defined by a lower portion 39 having connected thereto an L-shaped plate 41. End 25 is similar to end 23 and comprises legs 51 and 53 connected together by horizontal frame member 55 and 57. Connected to frame members 55 and 57 is a vertical support defined by a lower portion 59 and having connected thereto an L-shaped plate 61. Longitudinal connecting member 27 comprises a square tubular member 63 connected to frame member 35 and a square tubular member 65 of smaller cross-section connected to frame member 55 with tubular member 65 slideably fitted within tubular member 63. Member 65 may be moved inward and outward of member 63 to adjust the length of the base. A clamping arrangement 66 is provided for securing the two members 65 and 63 together at the desired position. As seen in FIG. 7, member 63 has a slot 67 formed at its end and two small plates 69 and 71 welded to the top and bottom of the end of member 63. Apertures 73 and 75 are formed in the plates to receive bolts 76 for tightening the end of member 63 to member 65 after member 65 has been inserted to the desired position in member 63.

Pivotally secured to the base for rocking motion about an upper axis is a support structure for supporting a bed. The support structure comprises arms 81 and 83 located at opposite ends 23 and 25 respectively of the base. Arm 81 is connected to a member 85 which is pivotally supported to vertical plate 41 by way of pivot member 87. Arm 83 is connected to a member 89 which is pivotally supported to vertical plate 61 by way of pivot member 91. The arms 81 and 83 are connected together by longitudinal member 93 and are employed for supporting opposite ends of a bed. Pivot members 87 and 91 are in alignment with each other and define an axis about which the arms 81 and 83 may be rocked or periodically tilted to rock or tilt the bed which they support.

As shown in FIG. 1, longitudinal member 93 comprises a square tubular member 95 connected to arm 81 and a square tubular member 97 of smaller cross-section connected to arm 83 with tubular member 97 slideably fitted within tubular member 95. Member 97 may be moved inward and outward of member 95 to adjust the length of the longitudinal member 93 in accordance with the length of longitudinal member 27. A clamping arrangement 99 similar to clamping arrangement 66 is provided to secure the members 95 and 97 together.

Arm 81 comprises a square tubular member 101 with two hook-shaped end members 103 and 105 slideably fitted into the opposite ends of member 101 for length adjustment purposes. The end members 103 and 105 are clamped in place by clamps 107 and 109 which are similar to clamp 66. Arm 83 is similar to arm 81 and comprises a square tubular member 111 which has two hook-shaped end members 113 and 115 slideably fitted into the opposite ends of member 111 for length adjustment purposes. The end members 113 and 115 are clamped in place by clamps 117 and 119 which are similar to clamp 66.

Most hospital beds have legs with adjusting knobs for attaching side rails to the bed. Such a bed is shown at 120 in FIG. 2. As seen in this Figure, leg member 121 telescopes in fixed leg member 123 and leg member 125 telescopes in fixed leg member 127. Knobs 129 and 131 located on the inside are threaded on fixed studs attached to fixed leg members 123 and 127. The bed is supported by the arms 81 and 83 by placing the adjusting knobs of each pair of legs in the bights of the hook-shaped end members of arms 81 and 83 respectively. This is illustrated in FIG. 2 wherein knobs 129 and 131 of one pair of legs of the bed are located in the bights of the end members 103 and 105 of arm 81.

The system for rocking or periodically tilting the arms 81 and 83 and hence the bed now will be described. Basically, this system comprises a drive mechanism comprising a motor 141 and gear assembly 143 for rotating a crank 145 about an axis 147. The drive mechanism is supported on a frame 149 connected to frame members 35 and 37. An arm or link 151 has one end pivotally connected to the crank by a pivot pin 153 and an opposite end pivotally connected to a guide or channel member 155 by a pivot pin 157. Channel member 155 is pivotally coupled to vertical plate 41 by a pivot pin 159 which defines a lower axis below pivot member 87. As the drive mechanism rotates the crank 145, the arm 151 rocks the channel member 155 about its axis 159. A coupling member 161 couples the lower portion 85A of member 85 to the channel 155 such that when the channel 155 is rocked about its axis, the member 85 and hence arms 81 and 83 and the bed supported thereby are rocked about the axis defined by the pivot members 87 and 91.

Figures 3, 4:
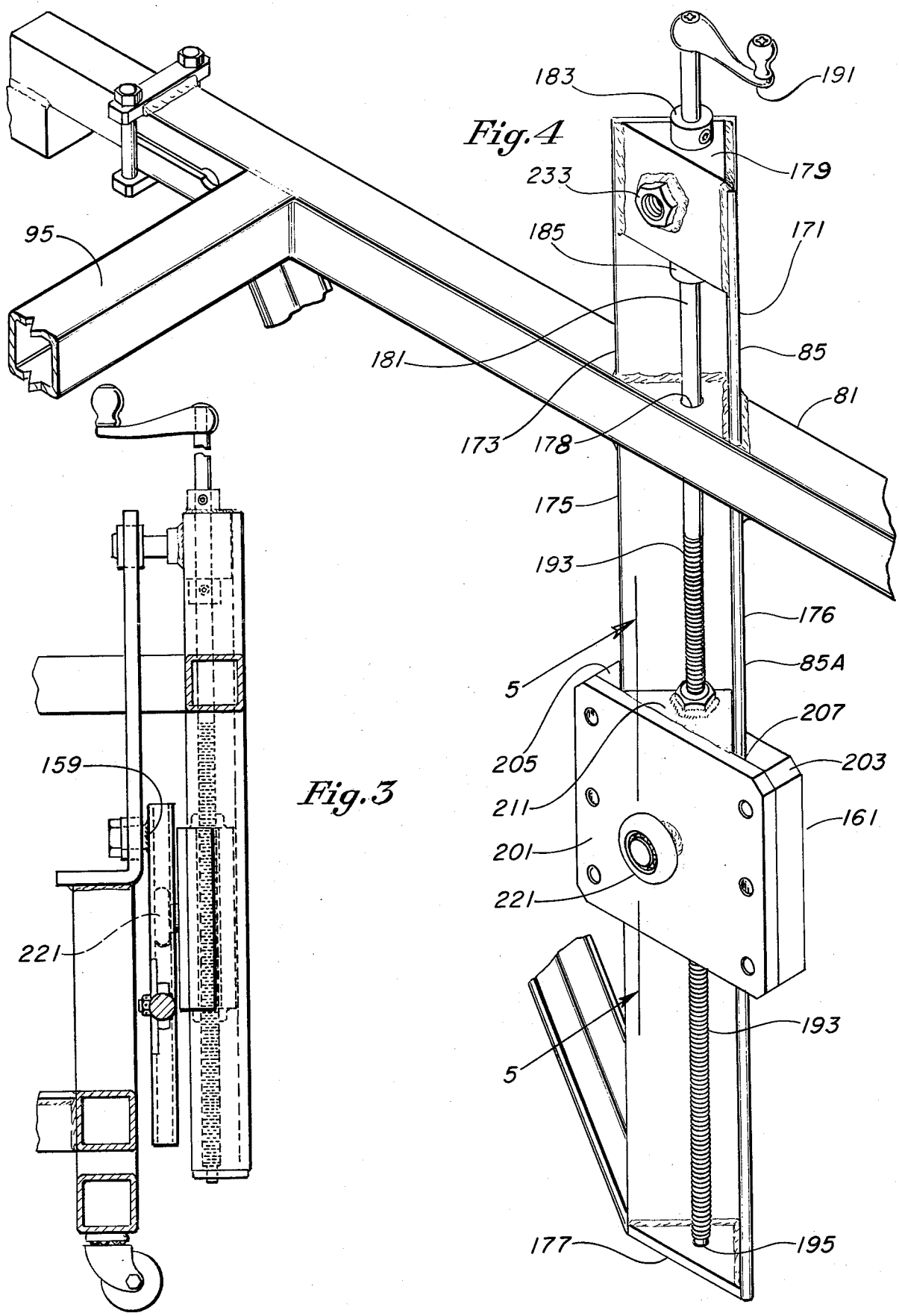
FIG. 3 is a side view of the right end portion of the apparatus as seen in FIG. 1.
FIG. 4 is a view of a portion of the structure at the right end of the apparatus as seen in FIG. 1 seen looking outward.

The position of the coupling member 161 may be adjusted relative to members 85A and channel 155 to adjust the angle through which the arms 81 and 83 and hence the bed supported thereby may be rocked or tilted. Referring to FIG. 4, member 85 is angle iron formed by sides 171 and 173 connected together such that the sides 171 and 173 define an angle of about 90° with respect to each other. Member 85A is similarly formed by sides 175 and 176. Members 85A and 85 are connected to the upper and lower surfaces of arm 81 respectively. A triangular shaped plate 177 is connected to the lower end of member 85A between sides 175 and 176. Member 81 has apertures 178 extending through its upper and lower surfaces. A triangular shaped member 179 is connected to member 85 between sides 171 and 173 and has an aperture 180 formed therethrough. (See FIG. 6). An elongated rod 181 is located in apertures 178 and 180. Rings 183 and 185 are attached to the rod 181 on opposite sides of the member 179 by set screws 187 and 189 to prevent axial movement of the rod. The diameters of the apertures 178 and 180 are large enough to allow the rod 181 to be turned therein by way of an upper handle 191. The lower portion of rod 181 is threaded at 193 and its lower end is inserted in an aperture 195 formed through plate 177.

Member 161 comprises a flat plate 201 having attached to its back side two plate members 203 and 205 which have 45° surfaces that engage the back side of side members 175 and 176 respectively. In FIG. 4, only 45° surface 207 of member 203 is shown. Members 201, 203 and 205 thus define a 90° triangular shaped opening with member 85A inserted therein. Although not shown, shims may be located between plate members 203 and 205 and the back side of plate 201 to increase the size of the opening. The opening is sufficient to allow member 161 to freely slide along member 85A whereby member 85A may be defined as a guide for member 161.

Figure 5:
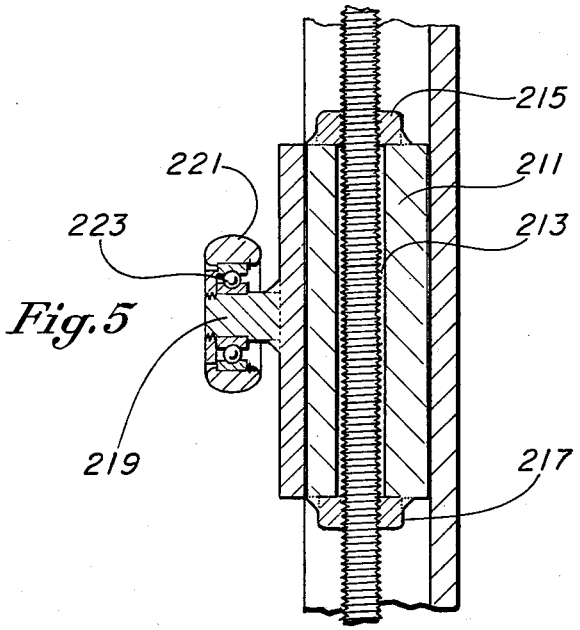
FIG. 5 is a cross-sectional view of FIG. 4 taken through the lines 5—5 thereof.

Member 161 may be moved to different positions along member 85A by rotating the rod 181. Connected to the back side of plate 201 and located within the 90° angle of sides 175 and 176 of member 85A is a triangular shaped member 211. Member 211 may freely move parallel to the sides 171 and 173 of member 85A but it cannot turn. As seen in FIG. 5, member 211 has an aperture 213 formed therethrough for receiving the threaded rod 181. Two nuts 215 and 217 are attached to opposite ends of the member 211 and the rod 181 is threaded through the nuts. Thus, rotation of the rod 181 causes the coupling member 161 to move up or down depending upon which direction the rod is rotated.

Attached to the front side of plate 201 is a rod 219 which supports a rotatable ring 221 by way of bearings 223. The ring 221 is located within the sides of the channel member 155. Thus, as the rod is rotated to position the member 161 at different locations along the member 85A, the ring 221 is positioned at different locations along the channel 155.

The member 161 may be moved over a range along member 85A between upper and lower positions to locate the ring 221 at the far lower end of channel 155 and at the level of the pivot pin or axis 159 of the channel. If the member 161 is located to position the ring 221 at the far lower end of channel 155, maximum tilt of the arms 81 and 83 and hence of the bed will be achieved during each half cycle of the rocking action. If the member 161 is located to position the ring 221 at the level of the pivot axis 159, then there will be no rocking or tilting motion imparted to the member 85A and hence to the arms 81 and 83 as the channel 155 is rocked about its axis. Thus, the bed will remain level.

In one embodiment, the system is constructed such that the maximum tilt of the arms 81 and 83 during each half cycle is 15° relative to the horizontal. The period of complete cycle is 1 hour. It has been found that if a slow drive is imparted to a firm mattress surface, a minimum amount of tilt is required to shift the patients weight to achieve improved circulation and to prevent bed sores. In our own operations, we have found that a 10° tilt produces very satisfactory results. The apparatus can be adjusted to fit any type or size of bed whereby conventional beds may be used without modification thereto. The rod 181 may be operated anytime during the cycle to achieve 0° tilt and hence to level the bed. This is desirable since it allows a nurse or aide to level the bed at anytime to care for the patient.

Although the handle 191 is shown connected directly to rod 181, the handle may be connected to a horizontally located shaft coupled to the rod 181 by way of a gear arrangement for rotating the rod 181. With this arrangement the bed will not interfere with rotation of the handle 191.

Referring to FIG. 6, the pivot means 87 comprises a bolt 231 threaded to a nut 233 secured to member 175. A bearing system 235 is supported by the end of the bolt which is fitted in an aperture 237 formed in the plate 41 to allow effective pivotal motion by the member 85. Pivot means 91 is formed in a similar manner.

I claim:

1. An apparatus for supporting and rocking a bed or the like, comprising:

base means, support means having structure for supporting a bed, said support means being pivotally coupled to said base means for rocking motion about a first axis, crank means, drive means coupled to said crank means for rotating said crank means, guide means pivotally coupled to said base means for rocking motion about a second axis spaced from said first axis, arm means having a first end pivotally coupled to said crank means, said arm means having a second end pivotally coupled to said guide means for rocking said guide means about said second axis as said crank means is rotated by said drive means, coupling means having a first portion coupled to said guide means and a second portion coupled to said support means for rocking said support means about said first axis as said guide means is rocked about said second axis, and adjusting means for adjusting the position of said coupling means relative to said support means and to said guide means to adjust the angle through which said support means may be rocked about said first axis.

2. The apparatus of claim 1, wherein:

said base means comprises:

first and second spaced apart end means, first longitudinal connecting means connecting together said first and second end means at spaced apart positions, and first and second vertical support means extending upward from said first and second end means respectively, said first and second vertical support means being located in alignment with each other for defining said first axis, said support means comprises:

first and second arm means pivotally coupled to said first and second vertical support means respectively for rocking motion about said first axis, second longitudinal connecting means connecting together said first and second arm means at spaced apart positions, said first and second arm means comprising structure for supporting opposite ends of a bed.

3. The apparatus of claim 2 wherein:

said first and second longitudinal connecting means and said first and second arm means are adjustable in length to allow said support means to support beds of different sizes.

4. The apparatus of claim 1 comprising:

first pivot means coinciding with said first axis and coupled to said base means and to said support means for allowing said support means to pivot in a rocking motion about said first axis, and second pivot means coinciding with said second axis and coupled to said base means and to said guide means for allowing said guide means to pivot in a rocking motion about said second axis, said second pivot axis being located below said first pivot axis.

5. The apparatus of claim 4 wherein:

said support means comprises guide means fixedly connected to said support means for rocking motion therewith, said guide means supported for rocking motion about said second axis having guiding surface means extending below said second pivot axis for engagement with said first portion of said coupling means, said guide means fixedly connected to said support means having guided surface means extending below said first pivot axis and to a lower position below said second pivot axis for engagement with said second portion of said coupling means, said adjusting means being adapted to adjust the position of said coupling means to locate its second portion to different positions along said guiding surface means of said guide means fixedly connected to said support means thereby locating said first portion of said coupling means to different positions along said guiding surface means to said guide means supported for rocking motion about said second axis.

6. The apparatus of claim 5 wherein:

said first portion of said coupling means may be moved along said guiding surface means of said guide means supported for rocking motion about said second axis between an upper position at or near said second axis to a lower position spaced from said second axis.

7. The apparatus of claim 5 wherein:

said guide means fixedly connected to said support means is located at a position outward of said guide means supported for rocking motion about said second axis.

* * * * *